United States Patent [19]

Armbruster

[11] Patent Number: 4,526,592

[45] Date of Patent: Jul. 2, 1985

[54] AIR CIRCULATOR AND AIR FILTRATION DEVICE

[76] Inventor: Joseph M. Armbruster, 2700 NE. 47th St., Lighthouse Point, Fla. 33064

[21] Appl. No.: 526,828

[22] Filed: Aug. 26, 1983

[51] Int. Cl.[3] ..... B01D 50/00; F24F 13/02

[52] U.S. Cl. ..... 55/276; 55/385 A; 55/419; 55/470; 55/472; 55/DIG. 29; 55/316; 98/DIG. 10; 98/33.1

[58] Field of Search ..... 55/276, 316, 350, 385 A, 55/419, 470, 472, DIG. 29; 98/33 A, DIG. 10

[56] References Cited

U.S. PATENT DOCUMENTS

| | | | |
|---|---|---|---|
| 1,493,497 | 5/1924 | Otis | 55/276 |
| 2,275,295 | 3/1942 | Greenway | 98/38 F |
| 2,886,124 | 5/1959 | Scharmer | 55/470 |
| 3,295,298 | 1/1967 | Mackey | 55/470 |
| 3,960,527 | 6/1976 | Goettl | 55/419 |
| 4,152,973 | 5/1979 | Peterson | 98/33 A |
| 4,252,547 | 2/1981 | Johnson | 55/316 |
| 4,385,911 | 5/1983 | Popek et al. | 55/316 |

*Primary Examiner*—David L. Lacey

*Attorney, Agent, or Firm*—Harvey B. Jacobson

[57] ABSTRACT

An air circulator and air filtration device for a room or other enclosed space supported in the corner thereof intermediate the floor and ceiling and including an upwardly opening top air inlet and a downwardly opening bottom air inlet with each inlet including a filter assembly and a pair of discharge outlets for discharging air horizontally in a path generally parallel to and adjacent the walls which intersect to form the corner in which the air circulator is mounted. The air circulator includes a single motor and an upper and lower blower assembly driven by the motor with the upper blower assembly communicating only with the upper air inlet and discharging toward one of the air outlets and the lower blower assembly communicating only with the bottom inlet and discharging toward the other of the outlets for maintaining a substantially constant and equal volume of air discharged along each of the intersecting walls of the room for effective circulation of air throughout the room and substantially eliminating temperature stratification in the room. Each air inlet filter assembly includes a foam pre-filter and an activated carbon filter for cleaning and purifying air being circulated.

15 Claims, 3 Drawing Figures

AIR CIRCULATOR AND AIR FILTRATION DEVICE

BACKGROUND OF THE INVENTION

1. Field of the Invention

The present invention generally relates to an air circulator and an air filtration device and more particularly a room air circulator mounted in the corner between the ceiling and floor for intake of air at the top and bottom thereof, with the air being filtered and a substantially equal and constant volume of air being discharged along the adjacent wall surfaces to effectively circulate air vertically and horizontally throughout the enclosed space defined by the room to substantially eliminate temperature stratification and to mix the air into a homogeneous mixture so that an occupant or occupants of the room will feel more comfortable at a higher temperature level by maintaining a substantially constant temperature throughout the vertical height and horizontal extent of the room and by providing a low velocity movement of air throughout the room.

2. Description of the Prior Art

The following U.S. patents relate to air circulators of various types: U.S. Pat. Nos. 2,337,182, Frankland, 12/1943, 2,635,524, Jenkins, 4-21-53, 2,886,124, Scharmer, 5/1959, 2,945,554, Berly, 7/1960, 3,008,402, Boulet, 11/1961, 3,173,353, Watkins, 3-16-65, 3,308,610, Springer et al, 3/1967, 3,347,025, Wiley, 10-17-67, 3,654,747, Remick, 4/1972, 3,687,053, Henson et al, 8/1972, 3,757,495, Sievers, 9/1973, 3,802,168, Deckas, 4-9-74, 3,827,342, Hughes, 8-6-74, 3,850,598, Boehm, 11/1974, 3,973,479, Whiteley, 8-10-76, 4,064,203, Cox, 12-20-77, 4,102,597, Itayama, 7-25-78, 4,136,606, Wolbrink, 1-30-79, 4,152,973, Peterson, 5-8-79, 4,194,945, Malev et al, 3/1980.

SUMMARY OF THE INVENTION

My U.S. Pat. No. 4,370,155, issued Jan. 25, 1983, discloses air circulators with FIGS. 5–7 of that patent disclosing a corner-mounted air circulator provided with a blower assembly with top and bottom air inlets and a pair of air outlets receiving air from the blower assembly and discharging it in a horizontal direction in the room in diverging directions and in diverging relationship to the walls which intersect to define the corner of the room.

An object of the present invention is to provide an air circulator and air filtration device which is an improved construction as compared to that in my U.S. Pat. No. 4,370,155, in which a pair of independent blowers circulate air from a top inlet to a lateral discharge and a bottom inlet to a lateral discharge respectively with the two lateral discharges being oriented adjacent and parallel to the surfaces of the walls which intersect to form a corner of a room so that one air outlet discharges air along one wall and the other air outlet discharges air along the other wall thereby providing a substantially equal and constant volume of air circulated along both of the walls which intersect to form the corner of a room.

Another object of the invention is to provide an air circulator in which the single motor is located between the blowers and connected to the rotor or impeller of each of the squirrel cage fans or blowers with each of the blowers including an axial inlet and tangential discharge directed toward its respective air outlet.

A further object of the invention is to provide an air circulator having the air outlets oriented adjacent to but spaced from the wall surfaces of the walls which intersect to form the corner of a room to provide a perimeter flow of air around the room with the flow originating at an elevated position above the floor and below the ceiling so that the two inlets and two outlets of the air circulator will efficiently circulate and mix air throughout the enclosed space defined by the walls, floor and ceiling thereby substantially eliminating stagnation, temperature stratification and provide a continuous air circulation in which the air being circulated is cleaned and purified by the air filter assembly associated with each air inlet thereby providing a more healthful environment for occupants of the room and maintaining the occupants more comfortable at a higher temperature level requiring the expenditure of less energy.

These together with other objects and advantages which will become susequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
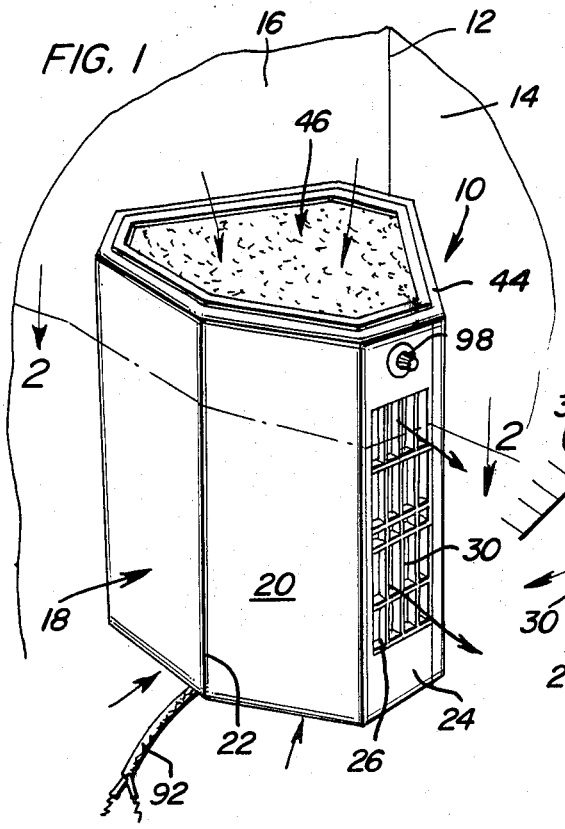
FIG. 1 is a perspective view of the air circulator and air filtration device of the present invention.
Figure 2:
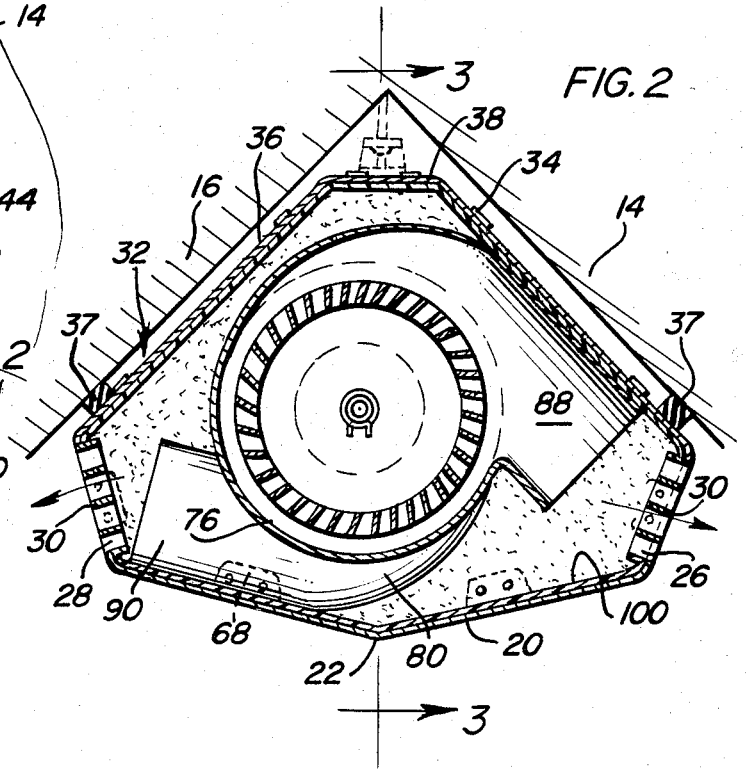
FIG. 2 is a transverse sectional view taken substantially upon a plane passing along section line 2—2 of FIG. 1 illustrating the structure of the housing, outlets and a portion of the upper blower assembly. p
Figure 3:
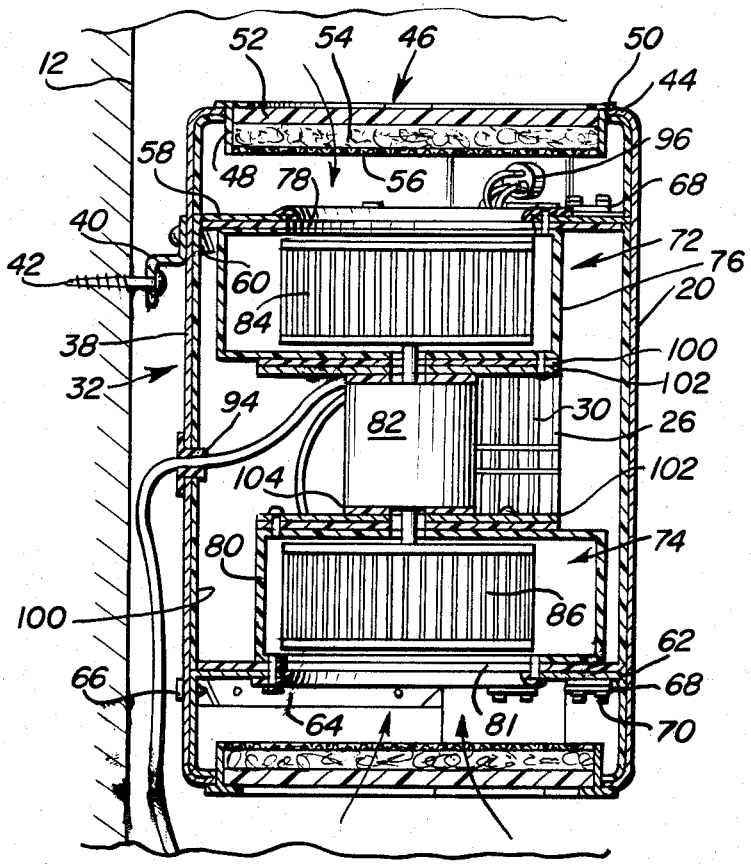
FIG. 3 is a vertical sectional view taken substantiall upon a plane passing along section line 3—3 of FIG. 2 illustrating further structural details of the air circulator including the two blower assemblies and the single motor oriented therebetween for driving the impellers on both of the blower assemblies.

Referring now specifically to the drawings, the air circulator and air filtration device of the present invention is generally designated by reference numeral 10 and is located in the corner 12 of a room defined by perpendicularly arranged intersecting walls 14 and 16. The air circulator includes a housing 18 which includes an outer or front wall 20 having a central vertical ridge 22 and angulated flat portions extending vertically from top to bottom edge of the housing 18 as illustrated in FIGS. 1 and 2. At each end of the front wall 20, a sidewall 24 is provided which extends towards the respective walls 14 and 16 as illustrated in FIG. 2 with the sidewalls including vertically disposed, elongated air outlet openings 26 and 28, respectively, having louvers 30 in the form of a gridwork therein to guide and deflect air discharged through the outlets 26 and 28, respectively. The housing includes a rear closure wall generally designated by numeral 32 which includes angulated portions 34 and 36 interconnected at their apex by a truncated corner portion 38 which bridges the corner 12 in spaced relation to the apex thereof so that a bracket 40 mounted on the truncated corner portion 38 may engage the head of a fastener 42 extending into the corner of the wall or into a suitable supporting structure in the wall to support the housing with the wall portions 34 and 36 parallel to the perpendicularly arranged intersecting walls 14 and 16 with the housing being spaced from the walls 14 and 16 by rubber isolation pads 37 as illustrated in FIG. 2. For convenience of access to the interior housing, the front wall 20 and the sidewalls 24 along with the gridwork or louvers 30 are of one-piece molded construction or of fiberglass reinforced plastic construction. The rear wall 32 is also of one-piece construction and detachably secured in place in a manner defined hereinafter with the rear wall 32 being of similar molded or fiberglass reinforced plastic. The upper and lower ends of both the front wall 20 and the rear wall 32 have an inturned flange 44 defining an opening receiving a filter assembly 46 which includes a peripheral wall 48 and an outwardly extending flange 50 at its outer end and including filtering materials 52 and 54 and a retaining screen 56 on the inner ends thereof with the filter material being a pre-filter foam 52 and activated charcoal second stage filter 54 to remove odors and purify the circulator air. The details of the filter are more specifically disclosed in my co-pending application, Ser. No. 467,074, filed Feb. 15, 1983, for Filter for Air Circulator.

The upper end portion of the housing 18 is provided with a transversely extending upper partition plate 58 having a downturned flange 60 and the lower portion of the housing 18 is provided with a similar partition plate 62 provided with a downturned flange 64 along the rear edges thereof for rigidifying the partition plate and also providing an attaching flange for the rear wall 32 with screw threaded fasteners 66 extending through the rear wall into the respective flanges 60 and 64 with the bracket 40 also being attached to the flange on the truncated portion of the partitions 58 and 62. The front wall 20 has inwardly extending tabs 68 formed integrally therewith which overlie the top and bottom surfaces of the respective partition plates 58 and 62 which are secured to the partition plates by screw threaded fasteners 70. Thus, the partition plates 58 and 62 which are in the form of sheetmetal plates of rigid construction provide an assembly for the front wall 20 and the rear wall 32 with the rear wall being easily removable and the size of the upper and lower opening defined by the flanges 44 is such that the filters 46 are frictionally retained in place so that they can be easily removed and replaced if desired or simple screw fasteners may be inserted into the peripheral wall of the filter through the front or rear wall of the housing to more securely retain the filter assemblies in place.

Positioned between the partition plates 58 and 62 is a pair of blower assemblies 72 and 74. Blower assembly 72 includes a generally cylindrical housing 76 that extends through and is rigidly connected to an opening 78 in the partition plate 58 with the upper end of the housing 76 extending through and being secured to the partition plate 58 and the lower blower assembly 74 includes a similar housing 80 which extends through a corresponding opening 81 in the partition 62 and is fixedly secured thereto such as by screw threaded fasteners or the like. Positioned between the housings 76 and 80 is a drive motor 82 having a drive shaft which extends upwardly and downwardly therefrom for driving a rotor or impeller 84 in the upper blower assembly and a rotor or impeller 86 in the lower blower assembly 74. As illustrated in FIG. 2, the upper blower assembly housing 76 includes a tangential discharge 88 directed toward the outlet 26 and the lower blower assembly housing 80 includes a tangential outlet 90 directed toward the outlet 28 so that air taken inwardly from the top of the housing is discharged from the outlet 88 toward outlet 26 along wall 14 and air taken in at the bottom of the blower assembly 74 will be discharged through outlet 90 toward outlet 28 along wall 16 with the air being discharged being cleaned and purified when it is moved through the filter assemblies 46. As shown, the blower discharges 88 and 90 are substantially perpendicular to the walls 14 and 16 so that the air will be discharged toward and through outlets 26 and 28 along the surfaces of walls 14 and 16.

An electrical supply cord 92 with an appropriate strain relief 94 extends through the rear wall and is connected to the motor 82 through a control switch 96 having an operating knob 98 extending through the sidewall 24 adjacent the upper end thereof with the switch including several positions for varying the rotational speed and thus the output of the blower assemblies 72 and 74 with the blower assemblies having the same volumetric capacity for discharging substantially and equal and constant volume of air along each of the walls 14 and 16.

The interior surfaces of the rear wall and front wall as well as the downwardly facing surface of the partition 58 and the upwardly facing surface of the partition 62 are provided with a layer of resilient foam plastic material or the like as indicated by numeral 100 to serve as sound deadening and insulating material in order to reduce noise produced by the rotating impellers of the squirrel cage blower or fan assemblies 72 and 74. A similar material is positioned between the blower housings and the partition plates and between the blower housings and a plate 102 engaged with each end of motor 82 with cork 104 or other material interposed between motor 82 and each plate 102. Also, the exterior of the housing may be provided in various decorative colors to enable the air circulator to be mounted in an office and be compatible with other decorative materials appearing in the room. The rear wall and partitions may be of unitary molded plastic material so that the molded plastic front wall and sidewalls which are unitary with the front wall can be removed and interchanged for color change or decor change.

The manner in which the discharge from the blower is associated with the outlets provides substantially equal flow of air from each of the outlets 26 and 28 with air being discharged throughout the vertical height of the outlets 26 and 28 although the velocity of the air in alignment with the outlets 88 and 90 will be somewhat greater than the velocity of air being discharged in vertically spaced relation thereto. The discharge of air from the outlets 88 and 90 provides a positive pressure interiorly of the housing so that air will be discharged throughout the vertical and horizontal extent of the respective outlets with the higher velocity being in the area of the outlets in alignment with the blower outlets 88 and 90. This arrangement provides for more effective air mixing and circulation along the perimeter of the room as the air moves adjacent and initially parallel to the surfaces of the walls and is dispersed upwardly and downwardly and laterally outwardly into the room as it moves around the perimeter thereof thereby assuring complete circulation of air throughout the room as air is pulled inwardly and upwardly from the floor area by the lower inlet and inwardly and downwardly from the ceiling area by the upper inlet thus enabling occupants of a room to feel more comfortable at a higher temperature in summer and a lower temperature in winter by providing a substantially constant temperature throughout the room and a low velocity air circulation thereby reducing energy consumption while providing a more healthful environment for occupants of the room.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An air circulator for providing circulation of air substantially throughout the total area of a room comprising a housing supported vertically at a corner of the room intermediate the floor and ceiling with the housing including an air inlet at the upper end portion thereof and an air inlet at the lower end portion thereof, said housing including a rear wall extending alongside of the surfaces of the walls which intersect to form the corner of the room and an air outlet along each opposite side portion thereof for discharging air in a horizontal direction generally parallel to and adjacent the surfaces of the walls which intersect to form the corner of the room, blower means interiorly of the housing for discharging substantially equal volumes of air from each outlet at substantially equal velocities.

2. The circulator as defined in claim 1 wherein said blower means includes a pair of independent blowers oriented one above the other within the housing, each blower having air inlet means communicating with the air inlets in said housing, motor means drivingly connected to said blowers with one blower having means discharging air toward one air outlet and the other blower having means discharging air toward the other air outlet.

3. The circulator as defined in claim 2 wherein said blowers are oriented in vertically spaced relation within the housing, said motor means including a motor disposed between the blowers and including an upwardly extending and downwardly extending drive shaft drivingly connected to the blowers.

4. The circulator as defined in claim 3 wherein each blower includes an impeller connected with the drive shaft, a housing for the impeller, said means discharging air from the blower comprising each impeller housing including a tangential discharge directed toward one of the outlets and said air inlet means for each blower comprising each impeller housing including an axial inlet opening aligned with an inlet in the air cirulator housing, each of said blowers being in the form of a squirrel cage blower.

5. The circulator as defined in claim 4 wherein said air circulator housing includes a pair of partition plates spaced inwardly from the upper and lower end thereof respectively with the impeller housings being secured to the partition plates.

6. The circulator as defined in claim 5 wherein the interior of the air circulator housing and at least one surface of each partition plate is provided with a coating of resilient material to reduce noise, and resilient material between each impeller housing and the partition plate and between the motor and each impeller housing for reducing vibration and noise produced by the air circulator.

7. The circulator as defined in claim 4 wherein each of said air outlets is vertically elongated and each impeller housing discharge is oriented in spaced, aligned and adjacent relation to one end of one of the air outlets and the air circulator housing to provide a positive pressure interiorly of the circulator housing for discharge of air throughout the vertical length of the air outlet with the higher velocity air being discharged from the air outlet in an area in alignment with the air discharged from the blower.

8. An air circulating device for providing circulation of air throughout substantially the total area of a room, comprising a housing defining an enclosed air chamber, a first upwardly facing top air inlet, a second downwardly facing bottom air inlet, first and second air outlets in said housing intermediate said top and bottom air inlets, blower means positioned within said air chamber intermediate said top and bottom air inlets, said blower means including vertically spaced impellers with a drive motor therebetween and drivingly connected thereto, each impeller being enclosed within an impeller housing, each impeller housing including a horizontally directed discharge, said first and second air outlets being positioned in outwardly facing diverging directions, one of said impeller housing discharges being spaced from and directed toward said first air outlets, the other of said impeller housing discharges being spaced from and directed toward said second air outlet whereby forced air discharged from said impeller housing discharges is directed toward and discharged from said first and second air outlets, respectively.

9. The air circulating device as defined in claim 8 wherein said air outlets are positioned alongside perpendicularly arranged walls adjacent a corner of the room to discharge air in directions generally paralleling said walls.

10. The air circulating device as defined in claim 9 wherein said air outlets are vertically elongated, said impeller housing discharges being directed toward an end portion of a respective air outlet for providing higher velocity air movement through the end portions of the air outlets with the space between the air outlets and impeller housing discharges pressurizing the enclosed air chamber, said air chamber defining housing including a pair of vertically spaced partitions spaced axially inwardly from the air inlets, each partition having an opening, each impeller housing having an inlet communicated with one of said partition openings.

11. In combination with a room including angularly disposed walls defining a corner of the room, an air circulator mounted in the corner of the room in vertically spaced relation to a floor and a ceiling, said air circulator including a vertically disposed housing having a hollow interior chamber with an upwardly facing air inlet and a downwardly facing air inlet communicating with the interior of the housing, said housing including vertically elongated outlets facing in divergent directions and generally discharging air in directions generally paralleling the room walls, said housing including vertically spaced horizontal partitions forming closures for the interior of the housing above said below the air outlets, each partition including an opening defining an air inlet communicating with the housing air inlets, air filtering means in each of the housing air inlets, a blower mounted on each of said partitions on the inward side thereof and having an inlet communicating with the opening in the partition, each blower including an air discharge directed toward one of the air outlets, means in said housing drivingly connected to the blowers for actuating the blowers for moving air from the air inlets to the air outlets, each blower air discharge including a discharge opening facing outwardly in the direction of one of said outlets and oriented in spaced relation thereto and in alignment with the end portion of the air outlet for discharging high velocity air toward the end portion of the air outlet and pressurizing the chamber for discharge of air throughout the length of the air outlets thereby providing air circulation throughout the length of the air outlets thereby providing air circulation throughout the room.

12. The combination as defined in claim 11 wherein said housing includes means supporting the housing from the corner of the room, said means driving the blowers including a single motor oriented between the blowers and including a drive shaft extending to and connected to each of the blowers.

13. The combination as defined in claim 12 wherein the interior of the housing is provided with a layer of resilient cushioning material for attentuating noise produced by the blowers and motor.

14. The combination as defined in claim 11 wherein each of said blowers includes an impeller and an impeller housing with each impeller housing having an inlet communicated with the opening in the partition and each impeller housing being secured to one of said partitions with the air inlets being isolated from the air outlet by the partitions having the openings therein communicated with the impeller housings.

15. The combination as defined in claim 11 wherein said air filtering means in each air inlet includes a prefilter panel of foam plastic material, a layer of activated charcoal inwardly of the foam material and a screen engaging the activated charcoal opposite to the foam layer to remove particulate material and purify the air passing therethrough.

* * * * *